US008307984B1

(12) United States Patent
Collier

(10) Patent No.: US 8,307,984 B1
(45) Date of Patent: Nov. 13, 2012

(54) PACKAGING INSERT FOR RETAINING AN ARTICLE WITHIN AN EXTERIOR BOX

(75) Inventor: Charles A. Collier, Renton, WA (US)

(73) Assignee: Columbia Corrugated Box, Tualtin, OR (US)

( * ) Notice: Subject to any disclaimer, the term of this patent is extended or adjusted under 35 U.S.C. 154(b) by 0 days.

(21) Appl. No.: 13/134,032

(22) Filed: May 26, 2011

(51) Int. Cl.
*B65D 81/02* (2006.01)

(52) U.S. Cl. ..... 206/591; 206/784; 229/87.02

(58) Field of Classification Search ..... 229/87.02; 206/784, 521, 591, 592, 594, 583
See application file for complete search history.

(56) References Cited

U.S. PATENT DOCUMENTS

| | | | | | |
|---|---|---|---|---|---|
| 1,682,410 | A * | 8/1928 | Oppenheim | 206/521 |
| 2,160,816 | A * | 6/1939 | Barnes | 206/586 |
| 2,176,274 | A * | 10/1939 | Parnin | 206/301 |
| 2,714,981 | A * | 8/1955 | Leavens | 206/591 |
| 2,742,219 | A * | 4/1956 | Van Antwerpen | 206/591 |
| 2,749,012 | A * | 6/1956 | Beach | 206/326 |
| 3,217,960 | A * | 11/1965 | Davis | 206/591 |
| 3,221,973 | A * | 12/1965 | Kalbrener | 206/600 |
| 4,360,145 | A * | 11/1982 | Wilcox | 206/586 |
| 4,606,460 | A * | 8/1986 | Luray | 206/583 |
| 4,809,904 | A * | 3/1989 | Yasutaniya | 229/68.1 |
| 4,865,200 | A * | 9/1989 | Sullivan et al. | 206/583 |
| 5,762,200 | A * | 6/1998 | Goudreau | 206/583 |
| 5,871,101 | A * | 2/1999 | Alden | 206/724 |
| 6,666,333 | B2 * | 12/2003 | Auclair | 206/521 |
| 2003/0116468 | A1 * | 6/2003 | Schwester | 206/592 |
| 2007/0284281 | A1 * | 12/2007 | Shimazu et al. | 206/592 |
| 2010/0000907 | A1 * | 1/2010 | Kashiwabara | 206/592 |

* cited by examiner

*Primary Examiner* — Jacob K Ackun

(57) ABSTRACT

A packaging container including a packaging insert suspending an article within an exterior box. The packaging insert is formed as a top portion overlying a bottom portion, each including a pair of side panels and a pair of end panels, corresponding top and bottom side panels being affixed together face-to-face such as with adhesive at manufacturing time, and corresponding top and bottom end panels being affixed together face-to-face at packaging time. The bottom end panels include bottom end panel extensions which trap the top end panels against the bottom end panels, and which include lock tabs engaging the bottom panel. The mated side panels are angled e.g. downward and the mated end panels are angled e.g. upward, to provide stand-off within an exterior box, protecting the packaged article. The top and/or bottom panels include break control means such as slotted holes, which control where each panel breaks when stressed around the packaged article by closure of the packaging insert. The article is further protected by angled regions formed as the panels break around the thickness of the article while the side and end panels are affixed face-to-face.

5 Claims, 5 Drawing Sheets

PACKAGING INSERT FOR RETAINING AN ARTICLE WITHIN AN EXTERIOR BOX

BACKGROUND OF THE INVENTION

1. Technical Field of the Invention

This invention relates generally to shipment packaging, and more specifically to packaging formed of corrugated fiberboard, containerboard, folding carton stock, paperboard, or the like, having an improved means of retaining articles packaged therein.

2. Background Art

Many form factors and configurations of corrugated fiberboard packaging (commonly known as "cardboard boxes") are used to protect various goods during shipment and storage. Because the packaging is typically not viewed as a value-add item by the consumer who purchases goods, and because the packaging still represents cost to the manufacturer of the goods, it is desirable to minimize the cost of the packaging. And because the goods are often valuable and fragile, it is desirable that the packaging provide quality, reliable protection for the goods. Further, because the goods are out of the manufacturer's control while in transit, and the consumer will return any damaged goods, it is important that the packaging provide robust protection, including adequate means for safeguarding against damage caused by dropping, crushing, penetrating, and otherwise abusing the packaged goods.

Further, it is desirable that the packaging be readily recyclable. One key aspect of recyclability is the number of different type materials used in the packaging; the fewer, the better.

DETAILED DESCRIPTION

Figure 1:
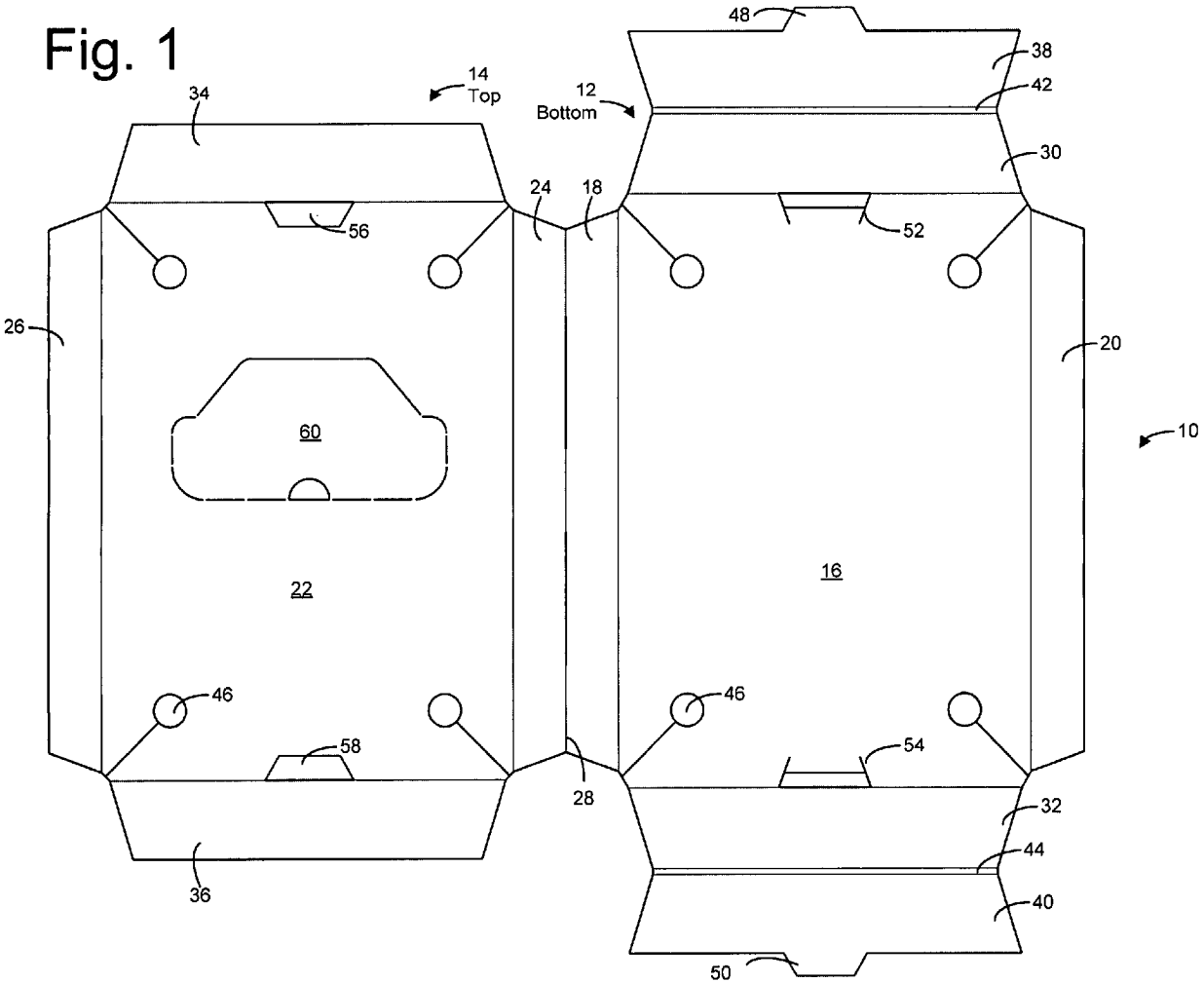
FIG. 1 shows a top plan view of a blank of foldable sheet material from which the container insert of the present invention may be formed.

The invention will be understood more fully from the detailed description given below and from the accompanying drawings of embodiments of the invention which, however, should not be taken to limit the invention to the specific embodiments described, but are for explanation and understanding only. For simplicity of explanation and illustration, the invention is illustrated in the drawings as having a rectangular configuration; however, in other embodiments contemplated by this disclosure, the invention could readily be fashioned to have other configurations, such as triangular, hexagonal, and the like. For ease of discussion, the invention will be described as being formed from corrugated fiberboard; however, the invention is not limited to such material, and can readily be employed using other materials, such as containerboard, paperboard, folding carton stock, paper, plastic, sheet metal, or what have you, any of which may generically be termed "foldable sheet material".

FIG. 1 illustrates a blank 10 of foldable sheet material according to one embodiment of this invention. The blank includes a bottom portion 12 and a top portion 14. In the embodiment shown, the bottom and top portions are formed as one unitary or monolithic piece; in other embodiments, they could be separate pieces joined by gluing, stapling, tab-and-slot joinery, or other suitable mechanisms.

The bottom portion includes a bottom panel 16 having a first bottom side panel 18 and a second bottom side panel 20 opposite the first bottom side panel. The top portion includes a top panel 22 having a first top side panel 24 and a second top side panel 26 opposite the first top side panel. In this monolithic embodiment, the first bottom side panel and the first top side panel adjoin each other at a central fold line 28 which may optionally be scored, perforation scored, or slit scored as per the requirements of the application at hand to facilitate their being folded into face-to-face abutment as will be shown later.

The bottom portion further includes a first bottom end panel 30 and a second bottom end panel 32 opposite the first bottom end panel. The top portion further includes a first top end panel 34 and a second top end panel 36 opposite the first top end panel. Optionally, but advantageously, the bottom end panels are supplied with first and second bottom end panel extensions 38, 40, respectively. The first and second bottom end panel extensions are separated from their bottom end panels by respective fold lines 42, 44, which may optionally, but advantageously, be double fold lines each, and may be scored, perforation scored, slit scored, embossed, or provided with other methods of creasing the material or otherwise causing it to fold as desired.

The bottom and top panels may optionally—but, again, advantageously—be provided with a set of relief means 46 located and sized for providing bending and breaking relief for the sheet material upon insertion of the packaged article, as will be explained below. In the embodiment shown, the relief means comprises a circular hole located generally near a corner of the top or bottom panel, and further comprises a slit cut from the circular hole to the corner of the top or bottom panel to a point between adjacent side and end panels. Other suitable relief means may include, for example, scores (regular, perforated, or slit) or pre-stressed folds in the sheet material.

The bottom end panel extensions may be provided with lock tabs 48, 50, and the bottom panel may be provided with matching lock tab receiving slots 52, 54, and the top panel may be provided with matching lock tab pass-through openings 56, 58.

Finally, the bottom and top panels may optionally be provided with other features not especially germane to the practice of this invention. For example, the top panel may be provided with a pop-out tab 60.

The sheet(s) from which the top and bottom portions are constructed, and pieces thereof, will be understood to include two opposing surfaces. For example, the bottom panel may be understood to have a top surface which is that visible to the reader in FIG. 1, and a bottom surface which is not visible (as it would be on the opposite side of the printed page).

Figure 2:
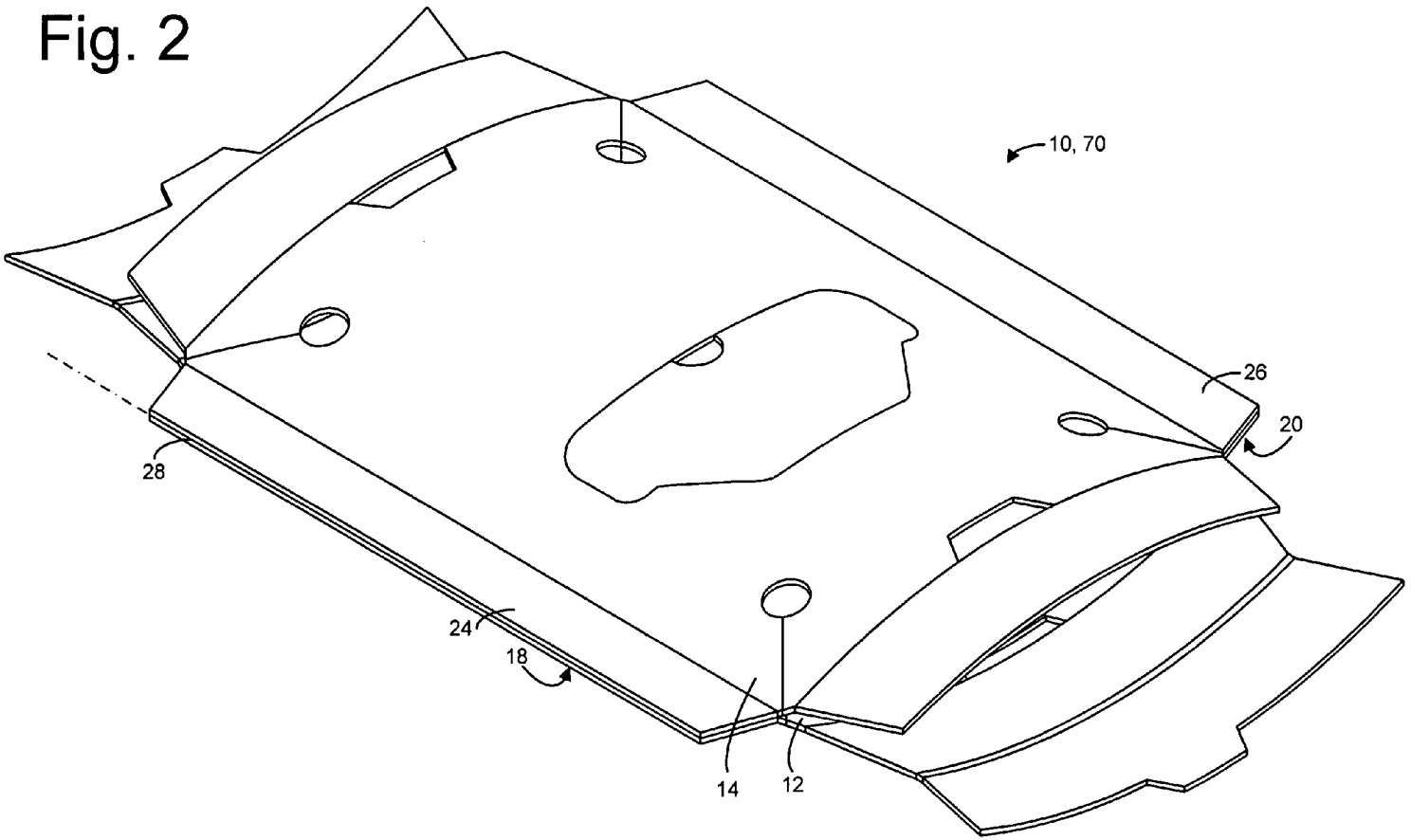
FIG. 2 shows an isometric view of a partially assembled container insert, formed by folding the blank of FIG. 1, and in a configuration ready to receive (or having already received) an article packaged therein for shipment.

FIG. 2 illustrates the blank 10 partially assembled into an insert 70. The reader should envision the blank of FIG. 1, with the top portion (on the left) having been folded at central fold line 28, pivoting upward out of the page, until it inverts atop the bottom portion (on the right).

Thus, in FIG. 2, the bottom portion 12 is mostly obscured from view by the top portion 14. The central fold line 28 is highlighted by the dashed line for the reader's convenience. The first side panel 18 of the bottom portion and the first side panel 24 of the top portion are in direct, face-to-face abutment. Similarly, the second side panel 20 of the bottom portion and the second side panel 26 of the top portion are in direct, face-to-face abutment. In one embodiment, the respective abutting pairs of side panels are secured in this configuration with glue. In other embodiments, staples or other means could be used to secure the side panels together. It is an important feature of this invention that the side panels are secured or affixed together, as will be explained below.

In one embodiment, the blank is folded and glued into this configuration at the time of manufacturing, and is shipped to the customer in this convenient, ready-to-use configuration. In another embodiment, the glue strips could be replaced by double-sided adhesive tape, optionally pre-applied to one of each pair of side panels with conventional, protective strips, and the blank is shipped to the customer in a flat, non-folded configuration. In this case, the customer removes the protective strips, folds the blank over onto itself, and secures the adhesive strips to the other halves of the side panel pairs. In another embodiment, the second upper and lower side panels could be configured in a manner which avoids the requirement for glue or tape; for example, the second upper and lower side panels could be segmented such that they interlock, or they could have lock tabs and slots, or one of them could have an extension which folds over similar to the operation of the end panel extensions. Alternatively, they could be sized such that, when placed into an exterior box, the second lower side panel is held at a downward angle and the second upper side panel is held at an upward angle within the box, whereby the outer edges of the top and bottom panels are held in close alignment to securely hold the packaged article.

As can be seen in FIG. 2, the top and bottom panels (16, 22 in FIG. 1) are in a somewhat bowed configuration. This visually indicates that an article has already been placed between them (by insertion through one of the open ends) for shipment. The relief mechanisms (46 in FIG. 1) are helpful in this regard, enabling the top and bottom panels to bend, but also to tend to break—meaning to fold along the direction of the corrugated material's fluting (not shown)—in controlled, desired locations, specifically, at or near the relief holes.

Figure 3:
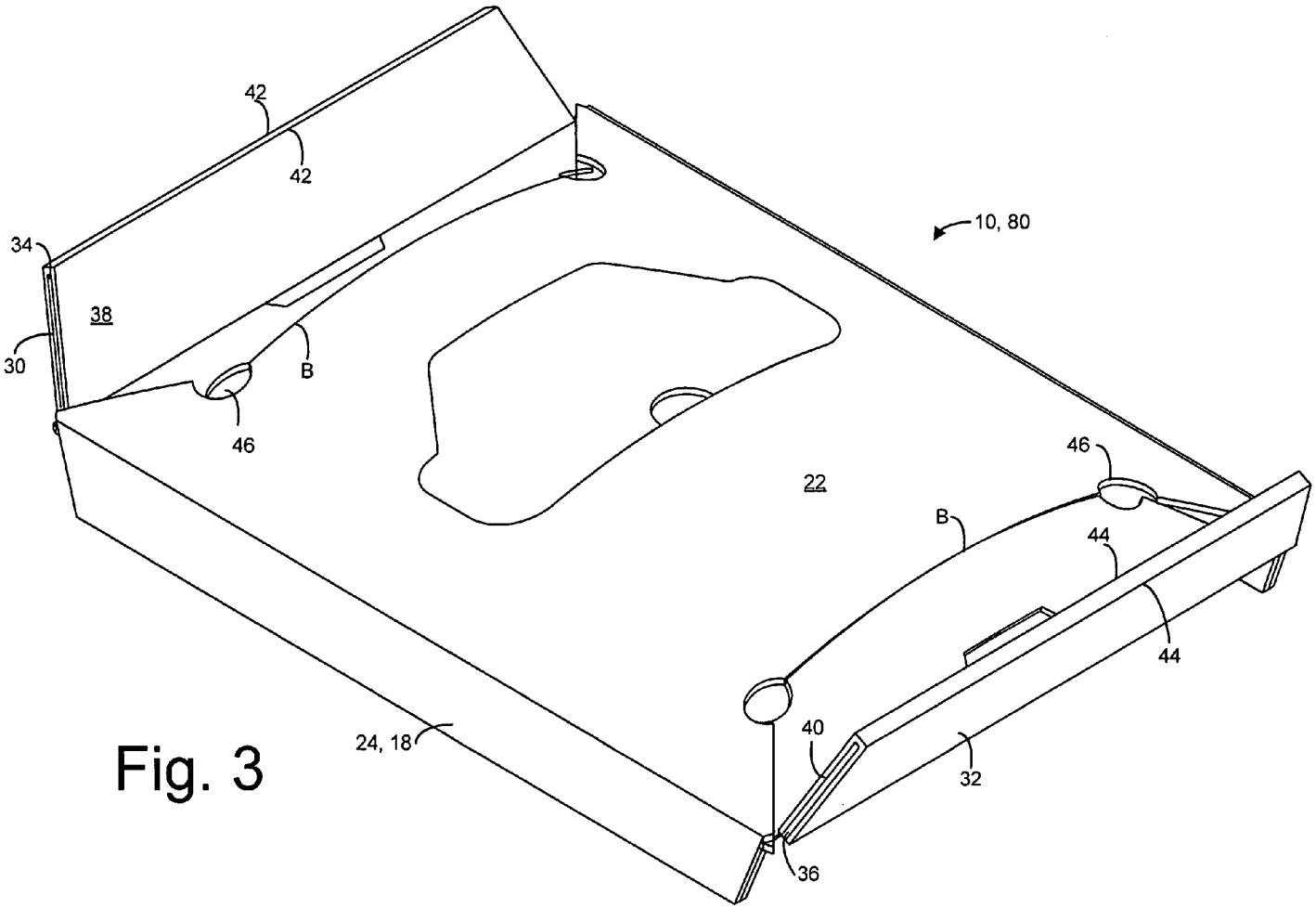
FIG. 3 shows an isometric view of a more fully assembled container insert, formed by further folding the container of FIG. 2, and in a configuration containing an article packaged therein for shipment, and which is ready for final assembly into a box.

FIG. 3 illustrates the fully assembled insert 80 enclosing an article (not visible) contained therein for shipment. As with FIG. 2, the top panel 22 almost entirely obscures visibility of the bottom panel.

After the user has inserted the article into the insert as in FIG. 2, to arrive at the configuration shown in FIG. 3, the user closes up the ends of the insert. First, the user places the bottom end panel 32 (or 30) generally into face-to-face abutment with the top end panel 36 (or 34) and folds the top end panel extension 40 (or 38) over and into face-to-face abutment with the opposite face of the bottom end panel. This is why it is advantageous to have a double-scored fold line 44 (or 42)—to allow a bit of room for the thickness of the captured top end panel. This will force the proximal ends of the end panels into tight alignment, and will tend to break the corrugated material, which will have been stressed by bending over the packaged article. One interesting feature of this invention is that, in this embodiment, the corrugated material is intentionally broken by forcing the proximal ends of the panels into tight alignment. The slotted relief holes 46 not only provide relief for the sections of the top and bottom panels near the end and side panels to overlap when this happens, they also provide a measure of control over where the top and bottom panels break, as shown by lines B. Advantageously, this tends also to be at or near an end of the enclosed article, providing some measure of control over end-to-end movement, of the packaged article. Those of skill in the art will understand how to properly orient the flute direction of the corrugated material in the construction of their blank, to enable this to work correctly.

Referring now to both FIGS. 3 and 1, after the end panels and end panel extensions have thus been mated, the lock tab 50 (or 48) is snapped through the pass-through opening 58 (or 56) and into locking engagement with the lock tab receiving slot 54 (or 52).

As can be seen in FIG. 3, the mated pairs of side panels may be fashioned so as to angle generally downward, while the mated pairs of end panels (and extensions) may be fashioned so as to angle generally upward. This optionally, but advantageously, provides a measure of "stand-off" for further protecting the packaged article.

Figure 4:
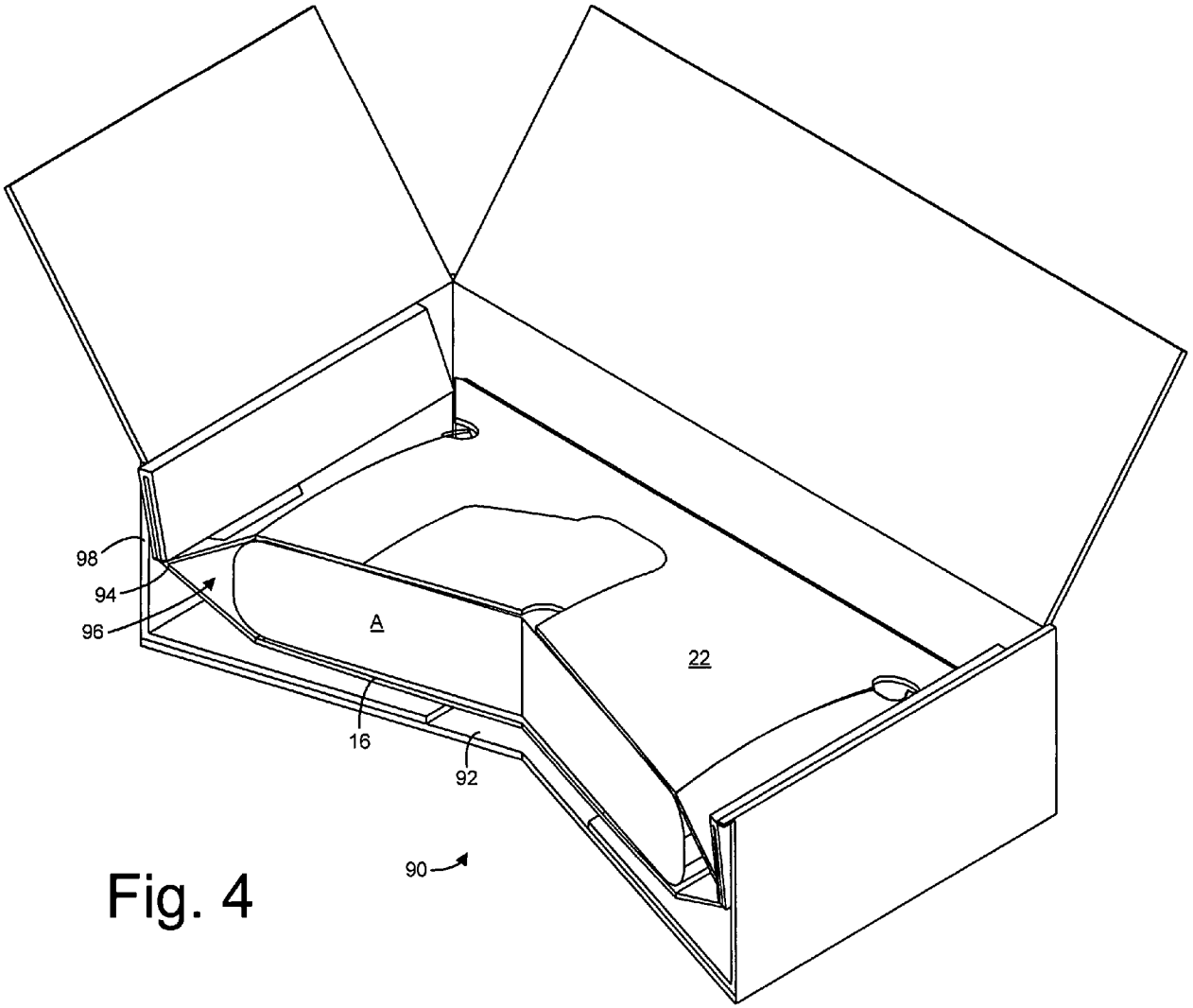
FIG. 4 is a cutaway isometric view of a fully assembled package, including an exterior box, within which is inserted the container insert of FIG. 3, within which is contained an article packaged therein for shipment.

FIG. 4 illustrates a fully assembled package 90 according to this invention. An article A has been packaged within the packaging insert 80, and the packaging insert has been placed within an exterior box 92.

The top panel 22 and bottom panel 16 have broken (at B) around the article due to the thickness of the article and due to the ends of the top and bottom panels being locked together at pinch-point 94. This creates an angled, wedge-shaped region 96 in which the extra-break segments of the top and bottom panels form a protective suspension region which is one of the interesting features of this invention. If the article were to attempt to move end-ward, such as might happen if the package were dropped on its end 98, the momentum of the article would attempt to force the article farther and farther into this wedge-shaped region, deforming and separating the angled-together segments of the top and bottom panels. The material of the panels will resist this deformation, providing protective shock absorption for the packaged article. The skilled container engineer will readily be able to select appropriate material, thickness, etc. for the panels, according to the needs of the application at hand, including both the mass and the thickness of the article to be packaged. Similarly, the sides of the top and bottom panels are formed into such wedge-shaped protective regions by the panels bending and/or breaking around the article and being locked together at the respective mating pairs of side panels. The skilled container engineer will further be able to select appropriate glue etc. for coupling the side panels together, to provide adequate strength and resiliency according to the application at hand.

Figure 5:
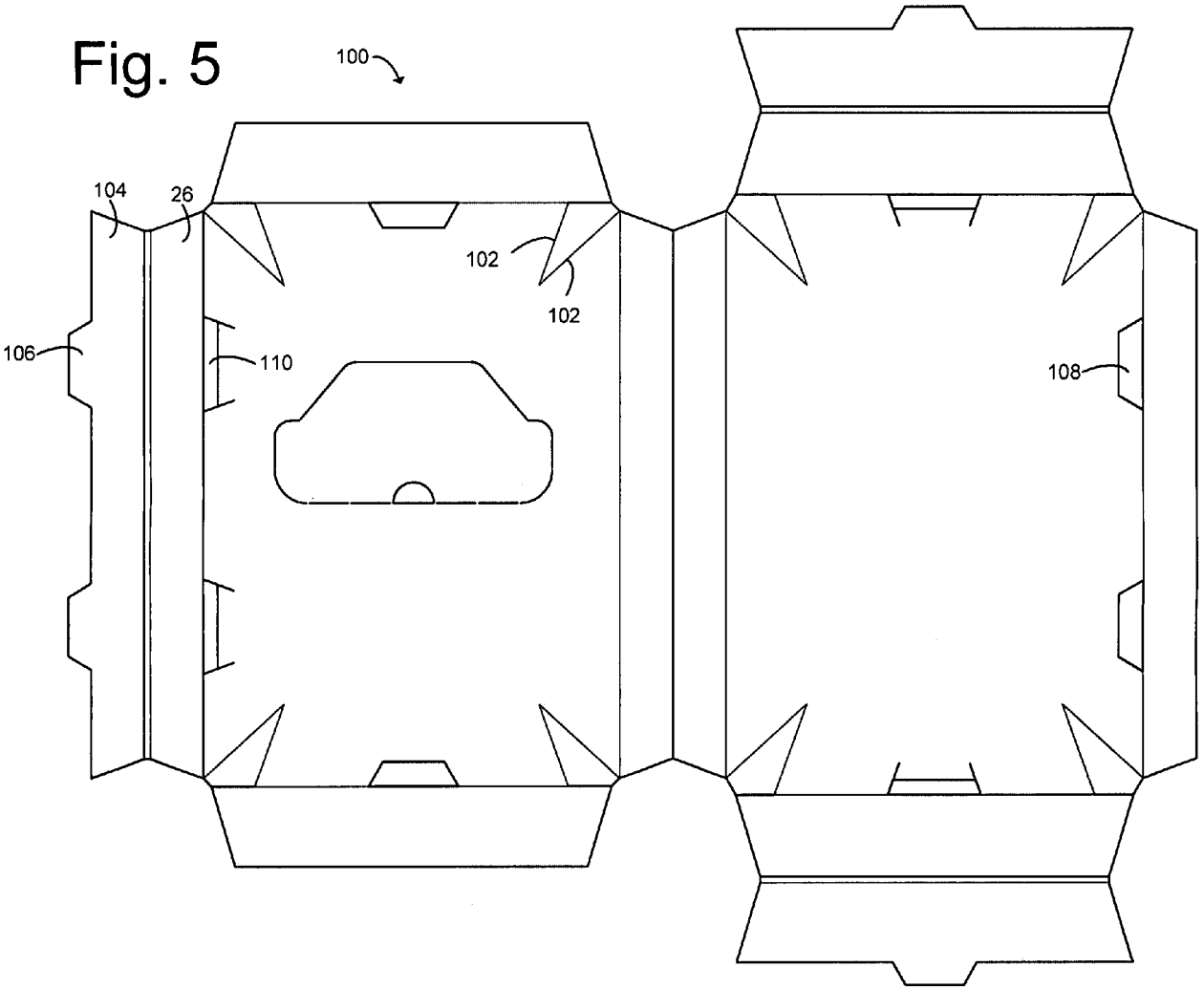
FIG. 5 shows a top plan view of another embodiment of a blank of foldable sheet material from which a container insert may be formed.

FIG. 5 illustrates an alternative embodiment of a blank 100 from which a container insert may be formed. The blank is substantially similar to that of FIG. 1, with two modifications. First, the slotted relief holes of the other embodiment have been replaced by a plurality of scores 102 which tend to determine where the container insert will break when the article is placed therein. And second, a top side panel extension 104 has been added to the second top side panel 26, with an optional lock tab 106 and corresponding lock tab pass-through slot 108 and lock tab receiving slot 110. This additional extension eliminates the need for a glue strip or other second-material means of coupling the second top side panel to the second bottom side panel. Optionally, in embodiments in which the top and bottom portions are formed as separate pieces of material, both side panels could be equipped with side panel extensions. Also, FIG. 5 illustrates the principle that not all of the extensions need be on the same portion; even in a configuration like that of FIG. 1, one end panel extension could be on the bottom portion and one end panel extension could be on the top portion.

CONCLUSION

As can be seen, by appropriately sizing the dimensions of the side and end panels, versus the depth of the exterior box and versus the thickness of the article, the skilled engineer can provide a desired stand-off distance between the bottom panel (and any immediately-adjacent parts of the article) and the bottom of the exterior box, and a desired stand-off distance between the top panel (and any immediately-adjacent parts of the article) and the top of the exterior box. These stand-off distances are helpful not only to prevent article damage from short-distance penetrating or crushing damage mechanisms, but also to prevent article damage which might otherwise occur if the package is dropped. The bowing of the top and bottom panels also provide some measure of spring-like suspension characteristic to the packaging insert.

The package can optionally be augmented with the addition of packaging peanuts, foam, bubble wrap, crumpled paper, or other materials between the bottom of the exterior box and the bottom panel of the insert, and/or between the top of the exterior box and the top panel of the insert, and/or on the ends and/or sides of the insert. However, in many applications this will be unnecessary, and in some applications it may in fact be undesirable for a variety of reasons.

Although no specific dimensions have been called out for the various panels described in this disclosure, the skilled reader will readily appreciate that suitable dimensions can be chosen to meet the needs of the application at hand.

And, although the packaging insert and the blank from which it is fashioned have been illustrated and described (for convenience) as being generally rectilinear in shape, the skilled reader will appreciate that this particular configuration is not a necessary limitation of the invention, and that the principles of the invention may be practiced in a variety of other shapes, such as triangular packaging, pentagonal packaging, hexagonal packaging, and so forth. And, although the packaging insert and its blank have been illustrated as having a high degree of lateral symmetry (for example, in FIG. 1, the generally parallel lines defining the central fold line and the left and right sides of the top and bottom panels, which result in the first end and the second end of the packaging insert having substantially the same size), this, too, is not a necessary limitation, and the invention could well be practiced in a rather asymmetrical configuration as well.

The term "lateral panel" is intended to refer generically to what has been described above as a side panel and/or an end panel.

Finally, the term "affixed" (such as when referring to the first top side panel being affixed face-to-face with the first bottom side panel) is intended to encompass any variety of means of at least semi-permanently mating them, whether it be glue strips, rolled glue, double-sided adhesive tape, staples, interlocking tabs, or what have you.

What is claimed is:

1. A packaging container for packaging an article, the packaging container comprising:

(1) an exterior box; and (2) a packaging insert disposed within the box and for containing the article, the packaging insert including, (a) a top portion including, a top panel having first and second surfaces, first and second sides, and first and second ends, a first top side panel coupled to the first side of the top panel, a second top side panel coupled to the second side of the top panel, a first top end panel coupled to the first end of the top panel, and a second top end panel coupled to the second end of the top panel, and (b) a bottom portion including, a bottom panel having first and second surfaces, first and second sides, and first and second ends, a first bottom side panel coupled to the first side of the bottom panel, a second bottom side panel coupled to the second side of the bottom panel, a first bottom end panel coupled to the first end of the bottom panel, and a second bottom end panel coupled to the second end of the bottom panel, (c) wherein, the first top side panel being affixed face-to-face against the first bottom side panel, the second top side panel being affixed face-to-face against the second bottom side panel, the first top end panel being affixed face-to-face against the first bottom end panel, the second top end panel being affixed face-to-face against the second bottom end panel, the side panels extending in a first direction, the first direction being one of upward and downward with respect to the packaging insert, the end panels extending in a second direction, the second direction being the other of upward and downward with respect to the packaging insert, the exterior box having an interior width greater than a width of the top panel and less than a width of the top panel plus a width of the first top side panel plus a width of the second side panel, such that the side panels are held at an angle within the exterior box to provide stand-off for the article in the first direction, and the exterior box having an interior length greater than a length of the top panel and less than a length of the top panel plus a length of the first top end panel plus a length of the second end panel, such that the end panels are held at an angle within the exterior box to provide stand-off for the article in the second direction.

2. The packaging container of claim 1 wherein the bottom portion further includes:

a first bottom end panel extension coupled to the first bottom end panel, the first top end panel being held between opposing faces of the first bottom end panel and the first bottom end panel extension; and a second bottom end panel extension coupled to the second bottom end panel, the second top end panel being held between opposing faces of the second bottom end panel and the second bottom end panel extension.

3. The packaging container of claim 1 wherein:

at least one of the top and bottom panels includes relief means for controlling where the at least one of the top and bottom panels breaks around the article.

4. The packaging container of claim 1 wherein:

the packaging insert is constructed of corrugated fiberboard.

5. The packaging container of claim 4 wherein:

the packaging insert is constructed of a monolithic piece of corrugated fiberboard.

* * * * *